US006585172B2

(12) United States Patent
Arghyris

(10) Patent No.: US 6,585,172 B2
(45) Date of Patent: Jul. 1, 2003

(54) DISPENSER HEAD AND FLUID PRODUCT DISPENSING DEVICE COMPRISING SAME

(75) Inventor: Laurent Arghyris, Sotteville-les-Rouen (FR)

(73) Assignee: Valois S.A., Le Neubourg (FR)

( * ) Notice: Subject to any disclaimer, the term of this patent is extended or adjusted under 35 U.S.C. 154(b) by 136 days.

(21) Appl. No.: 09/762,093

(22) PCT Filed: Feb. 2, 2001

(86) PCT No.: PCT/FR99/01857

§ 371 (c)(1),
(2), (4) Date: Feb. 2, 2001

(87) PCT Pub. No.: WO00/07736

PCT Pub. Date: Feb. 17, 2000

(65) Prior Publication Data

US 2002/0134863 A1 Sep. 26, 2002

(30) Foreign Application Priority Data

Aug. 4, 1998 (FR) ..... 98 09984

(51) Int. Cl.[7] ..... B05B 1/34

(52) U.S. Cl. ..... 239/491; 239/488; 239/494; 239/490; 239/492; 222/321.7

(58) Field of Search ..... 239/491, 469, 239/490, 468, 463, 492, 488, 489; 222/321.7

(56) References Cited

U.S. PATENT DOCUMENTS

| | | | | |
|---|---|---|---|---|
| 4,251,032 A | * | 2/1981 | Werding | 222/386.5 |
| 4,479,593 A | * | 10/1984 | Bundschuh | 222/321.7 |
| 5,593,094 A | * | 1/1997 | Barriac et al. | 239/476 |

FOREIGN PATENT DOCUMENTS

| | | |
|---|---|---|
| BE | 510614 | 4/1952 |
| DE | 91 908 | 5/1897 |
| DE | 41 37 799 | 5/1993 |
| FR | 2 318 684 | 2/1977 |
| FR | 2 622 478 | 5/1989 |

* cited by examiner

*Primary Examiner*—Steven J. Ganey
(74) *Attorney, Agent, or Firm*—Sughrue Mion, PLLC

(57) ABSTRACT

A dispenser head (10) for a fluid dispenser device, said head (10) comprising an expulsion channel (11) terminating in a dispensing orifice (12), an insert (20) being placed in said expulsion channel (11), the downstream end (21) of said insert (20) in the flow direction of the fluid co-operating with the downstream end portion of said expulsion channel (11) to define a spraying profile (13, 14), the head being characterized in that said downstream end (21) of said insert (20) and said downstream end portion of said expulsion channel (11) are both frustoconical, forming a frustoconical spraying profile (13, 14).

8 Claims, 1 Drawing Sheet

DISPENSER HEAD AND FLUID PRODUCT DISPENSING DEVICE COMPRISING SAME

Figure 1:
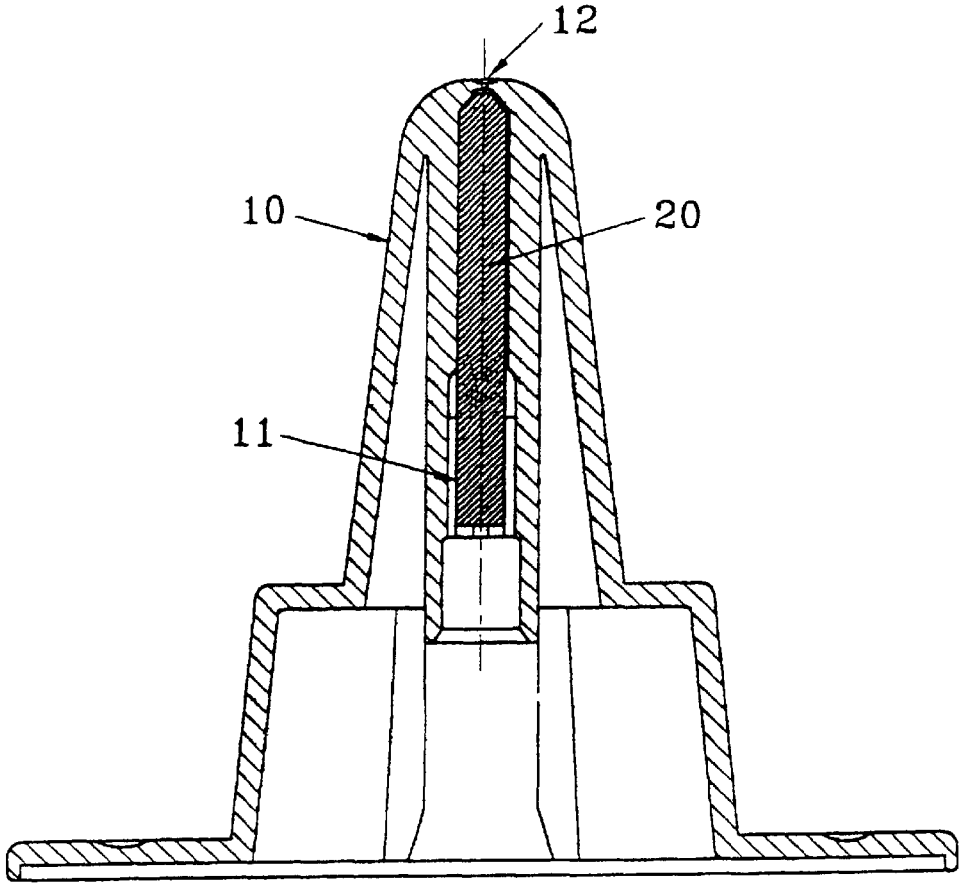

The present invention relates to an improved dispenser head and to a fluid dispenser device incorporating such a dispenser head.

For certain types of fluid dispenser device with which it is desired to dispense fluid in the form of a fine spray, it is known to form a spraying profile upstream from the dispenser orifice, the profile generally comprising a swirling chamber fed by one or more swirling channels. Spray devices of those types are nowadays in widespread use in a large number of fields, in particular in pharmacy, perfumery, and cosmetics.

Document EP-0 131 501 discloses a pusher for a spray, in which a cylindrical insert of constant section is inserted into the expulsion channel. The end face of the insert which is perpendicular to the axis of said insert co-operates with the end wall of the expulsion channel to define a spraying profile including a swirling chamber and one or more swirling channels connecting the expulsion channel to said swirling chamber. In the embodiment disclosed in document EP-0 131 501, said spraying profile is formed in the end wall of said expulsion channel, and the end face of the insert is plane.

That type of device can nevertheless present drawbacks in some cases. Thus, in particular for a nasal pusher, it can be desirable to make said pusher with a hemispherical tip. This can give rise to problems during molding, particularly when the volume of the swirling chamber is small. Combining a hemispherical tip with a horizontal spraying profile extending transversely to the longitudinal axis of the head can give rise to problems, particularly concerning the thickness of the end wall of the head. Under such circumstances, one solution lies in reducing the transverse size of the expulsion channel and the insert, and thus the size of the spraying profile. Nevertheless, that gives rise to an increase in the risk of the pusher becoming clogged in said spraying profile.

An object of the present invention is to provide a dispenser head and a fluid dispenser device incorporating such a dispenser head but which do not reproduce the above-mentioned drawbacks.

An object of the invention is thus to provide a dispenser head including a spraying profile and operating in safe and reliable manner even with a dispenser head tip that is hemispherical.

Another object of the present invention is to provide a dispenser head including a spraying profile in which the risk of said spraying profile becoming clogged is diminished.

Another object of the present invention is to provide a dispenser head including a spraying profile which is easily molded without problems concerning quality at the tip of the head, and which enables materials to be used that further reduce the risk of clogging.

The present invention thus provides a dispenser head for a fluid dispenser device, said head comprising an expulsion channel terminating in a dispensing orifice, an insert being placed in said expulsion channel, the downstream end of said insert in the flow direction of the fluid co-operating with the downstream end portion of said expulsion channel to define a spraying profile, said downstream end of said insert and said downstream end portion of said expulsion channel being both frustoconical, forming a frustoconical spraying profile.

Preferably, said spraying profile comprises a swirling chamber and at least one swirling channel, said swirling chamber being directly connected to said dispensing orifice.

Advantageously, at least one swirling channel connects the expulsion channel to said swirling chamber, the channel (s) being formed on the conical portion of the frustoconical spraying profile and said swirling chamber being formed on the top of the truncated cone of the frustoconical spraying profile.

Advantageously, said frustoconical spraying profile is formed by grooves formed in the walls of the expulsion channel, said insert covering said grooves.

Preferably, said insert occupies substantially all of the volume of the expulsion channel so as to define a narrow expulsion channel.

Advantageously, the tip of said head incorporating said dispensing orifice is hemispherical.

The present invention also provides a fluid dispenser device including a dispenser head as defined above.

Figure 2:
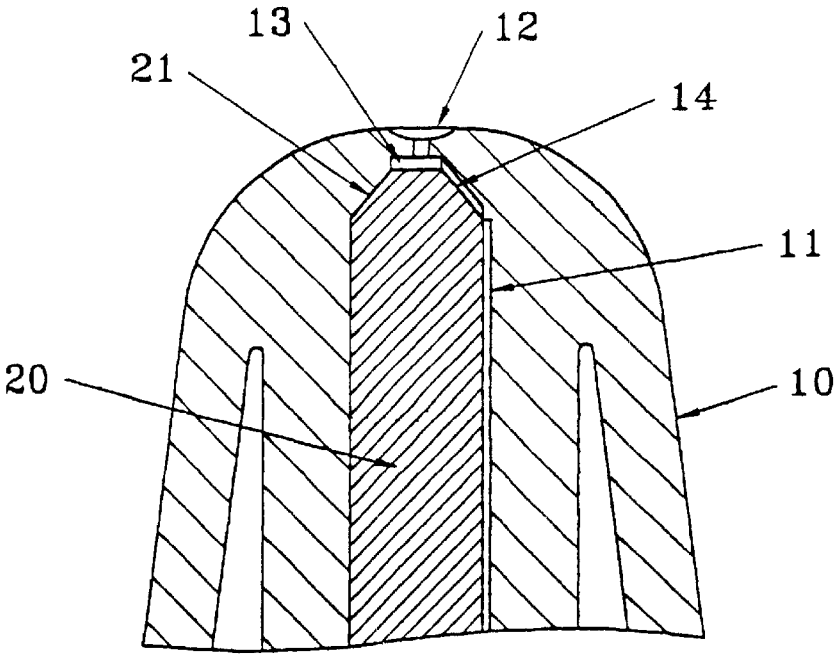

Other characteristics and advantages of the invention appear more clearly in the following detailed description of a preferred embodiment of the invention, given by way of non-limiting example and with reference to the accompanying drawing, in which:

FIG. 1 is a diagrammatic longitudinal section view of a dispenser head in a preferred embodiment of the present invention; and FIG. 2 is an enlarged detail view of the FIG. 1 dispenser head.

The present invention, which relates mainly to implementing a particular spraying profile in a dispenser head of a fluid dispenser device, is adaptable to all fluid dispenser devices that include such a spraying profile. Nevertheless, a particularly advantageous application of the present invention relates to nasal dispenser devices, and the present invention is thus described with reference to a nasal pusher. It should nevertheless be clear that the present invention is not limited to this application example.

With reference to the figures, the dispenser head 10 incorporates an expulsion channel 11 which extends in said head 10 between an upstream portion for connection to the dispenser member, e.g. a pump, of the dispenser device on which the head is to be applied, and a downstream end incorporating a dispenser orifice 12. To limit the dead volume in the expulsion channel 11 and to enable dispensing to take place in the form of a spray, an insert 20 is placed inside said expulsion channel and extends preferably substantially over the entire length of said expulsion channel 11. Said insert 20 preferably occupies substantially the entire volume of the expulsion channel 11 leaving only a narrow passage as the expulsion channel.

In conventional manner, e.g. as described in document EP-0 131 501, the downstream end of the insert 20 in the flow direction of the fluid co-operates with the downstream end portion of the expulsion channel 11 (or the end wall portion of the expulsion channel) to define a spraying profile, to further enhance dispensing in the form of a fine spray. This spraying profile can be of any kind, but it generally comprises one or more swirling channels which connect the expulsion channel to a swirling chamber located immediately upstream from the dispensing orifice.

In the invention, said downstream end 21 of the insert 20 and said downstream end portion of the expulsion channel 11 are both frustoconical in shape, thereby forming a frustoconical spraying profile. As shown in FIG. 2, this frustoconical spraying profile preferably comprises a swirling chamber 13 and one or more swirling channels 14, said swirling chamber 13 being directly connected to said dispensing orifice 12. In conventional manner, the swirling channel(s) 14 connect the expulsion channel 11 to the swirling chamber 13, but unlike the prior art device, said spraying profile 13 and 14 is not made to occupy a plane extending transversely relative to the longitudinal axis of the pusher. The swirling channel(s) 14 are advantageously formed on the conical portion of the frustoconical spraying profile whereas said swirling chamber 13 is advantageously formed at the top of the truncated cone of said frustoconical spraying profile. In application of elementary rules of geometry, this configuration enables the length of said swirling channels 14 to be increased even when the head 10 is made to be hemispherical, as can be the case with a nasal pusher. Furthermore, as can be seen in FIG. 2, the presence of the frustoconical spraying profile of the invention makes it possible to avoid any problems of quality during molding of the tip of the head, thereby facilitating manufacture thereof.

Advantageously, the frustoconical swirling profile of the invention, i.e. the swirling chamber 13 and the swirling channel(s) 14, is formed inside the frustoconical end wall of the expulsion channel 11, and the insert 20 has an outside surface that is smooth. After said insert 20 has been put into place inside the expulsion channel it forms a covering for said grooves in the swirling profile. This configuration prevents any risk of the swirling profile being damaged during assembly of the insert inside the expulsion channel.

The present invention thus makes it possible to provide a dispenser head including a spraying profile that is particularly adapted to nasal type pushers, and presenting the following advantages:

- the pusher can be made to have a hemispherical tip which facilitates use both by adults and by children, without any problems in the quality of the molding at the tip of the head;
- the contact area between the insert and the spraying profile is increased because of the conical bearing surface, thereby reducing the risk of clogging at this point; and
- the insert can be made of a material such as polypropylene or acetal that enables the risk of the pusher clogging to be reduced even further.

The dispenser head of the invention, particularly the head described above with reference to the figures, can naturally be fitted to any type of appropriate fluid dispenser device.

Although the present invention is described with reference to a preferred embodiment thereof, it is not limited to this particular embodiment and on the contrary it can be adapted to all types of fluid dispenser device without going beyond the ambit of the present invention, as defined by the accompanying claims.

What is claimed is:

1. A nasal dispenser head (10) for a fluid dispenser device, said head (10) comprising an expulsion channel (11) terminating in a dispensing orifice (12), an insert (20) being placed in said expulsion channel (11), the downstream end (21) of said insert (20) in the flow direction of the fluid co-operating with the downstream end portion of said expulsion channel (11) to define a spraying profile (13, 14), the head being characterized in that said downstream end (21) of said insert 20) and said downstream end portion of said expulsion channel (11) are both frustoconical, forming a frustoconical spraying profile (13, 14), said insert (20) occupying substantially all of the volume of the expulsion channel (11) so as to define a narrow expulsion channel (11).

2. A dispenser head according to claim 1, in which said spraying profile comprises a swirling chamber (13) and at least one swirling channel (14), said swirling chamber (13) being directly connected to said dispensing orifice (12).

3. A dispenser head according to claim 2, in which said at least one swirling channel (14) connects the expulsion channel (11) to said swirling chamber (13), the channel(s) (14) being formed on the conical portion of the frustoconical spraying profile and said swirling chamber (13) being formed on the top of the truncated cone of the frustoconical spraying profile.

4. A dispenser head according to claim 1, in which said frustoconical spraying profile (13, 14) is formed by groove formed in the walls of the expulsion channel (11), said insert (20) covering said grooves.

5. A dispenser head according to claim 1, in which the tip of said head (10) incorporating said dispensing orifice (12) is hemispherical.

6. A fluid dispenser device including a dispenser head (10) according to claim 1.

7. An elongated nasal fluid dispenser head for spraying a fluid, comprising:

- an elongated external member configured to be manually inserted into a nasal passage for praying a fluid inside the nasal passage;
- an expulsion channel extending within the elongated external member and terminating in a dispensing orifice;
- an insert placed in the expulsion channel, a downstream end of said insert in the flow direction of the fluid co-operating with a downstream end portion of said expulsion channel to define a spraying profile; and
- wherein the downstream end of said insert and the downstream end portion of the expulsion channel are both frustoconical, forming a frustoconical spraying profile; and
- wherein the insert occupies substantially all of the volume of the expulsion channel so as to define a narrow expulsion channel.

8. The fluid dispenser according to claim 7, wherein the an elongated external member is a narrow conical member.

* * * * *

UNITED STATES PATENT AND TRADEMARK OFFICE

CERTIFICATE OF CORRECTION

PATENT NO. : 6,585,172 B2
DATED : July 1, 2003
INVENTOR(S) : Laurent Arghyris

It is certified that error appears in the above-identified patent and that said Letters Patent is hereby corrected as shown below:

Title page,
Item [22], PCT Filed: delete "Feb. 2, 2001", and insert therefor -- July 28, 1999 --.

Signed and Sealed this

Twenty-fourth Day of August, 2004

JON W. DUDAS
*Director of the United States Patent and Trademark Office*